US005574478A

United States Patent [19]

Bril et al.

[11] Patent Number: 5,574,478

[45] Date of Patent: Nov. 12, 1996

[54] VGA COLOR SYSTEM FOR PERSONAL COMPUTERS

[75] Inventors: Vlad Bril, Campbell; Boyd G. Pett, San Jose, both of Calif.

[73] Assignee: Cirrus Logic, Inc., Fremont, Calif.

[21] Appl. No.: 874,038

[22] Filed: Apr. 27, 1992

[51] Int. Cl.[6] ..... G09G 5/00

[52] U.S. Cl. ..... 345/132; 345/150; 395/788

[58] Field of Search ..... 345/150, 153, 345/144, 112, 113, 114, 115, 186, 132, 133, 155, 196, 199, 201; 395/131, 162, 164

[56] References Cited

U.S. PATENT DOCUMENTS

| | | | |
|---|---|---|---|
| 4,437,092 | 3/1984 | Dean et al. | 345/144 |
| 4,804,948 | 2/1989 | Nishi et al. | 345/186 |
| 4,823,120 | 4/1989 | Thompson et al. | 345/199 |
| 5,083,119 | 1/1992 | Trevett et al. | 345/115 |
| 5,225,875 | 7/1993 | Shapiro et al. | 345/150 |
| 5,379,049 | 1/1995 | Leach | 345/153 |
| 5,491,496 | 2/1996 | Tomiyasu | 345/186 |

OTHER PUBLICATIONS

*Macintosh MacPaint*, pp. 1–34, 1983.

*Primary Examiner*—Richard Hjerpe
*Assistant Examiner*—Kara Farnandez Stoll
*Attorney, Agent, or Firm*—Blakely, Sokoloff, Taylor & Zafman

[57] ABSTRACT

Modifications to a prior art system known as video graphics adapter (VGA) for displaying color images on a monitor attached to a personal computer. The modifications provide the following four enhancements to a standard VGA system: (i) user definable border color; (ii) automatic powering down of the digital analog converter (DAC) component of the VGA RAMDAC and monitor sense comparator for LCD monitors when the RAMDAC is not in use; (iii) stopping of the RAMDAC clock for LCD monitors when the RAMDAC is not in use; and (iv) true color support.

3 Claims, 6 Drawing Sheets

VGA COLOR SYSTEM FOR PERSONAL COMPUTERS

SUMMARY OF THE INVENTION

Modifications are disclosed to a prior art system known as video graphics adapter (VGA) for displaying color images on a monitor attached to a personal computer. The modifications provide the following four enhancements to a standard VGA system: (i) user definable border color; (ii) automatic powering down of the digital analog converter (DAC) component of the VGA RAMDAC and monitor sense comparator for LCD monitors when the RAMDAC is not in use; (iii) stopping of the RAMDAC clock for LCD monitors when the RAMDAC is not in use; and (iv) true color support.

In such a monitor display attached to a computer, the region between the active display area and the physical edge of the monitor's CRT is referred to as the border. In the United States, the border of most monitors is black or close to black. However, in European countries, ergonomic standards provide for user selection of the border color. When using the microcomputer color standard known as VGA, while it is possible to change the border color to one of 256 colors, the color it is changed to cannot be selected by the user since the color is application dependent. One aspect of the present invention is directed to certain modifications to the hardware used to implement VGA to allow full user control of the border color.

Another aspect of the present invention is to provide a capability to power down the DAC component of the RAMDAC to reduce power consumption in systems using an LCD monitor.

A third aspect of the present invention is to provide a capability to suspend a clock known as the RAMDAC-DotClock to reduce power consumption in systems using an LCD monitor.

A fourth aspect of the present invention is to provide true color mode support. That is, instead of generating a color display based upon a 256 color palette or look up table as provided by the VGA standard, a capability of directly supplying RGB data to the DAC without going through a look-up table is described.

DETAILED DESCRIPTION OF THE INVENTION

Figure 1:
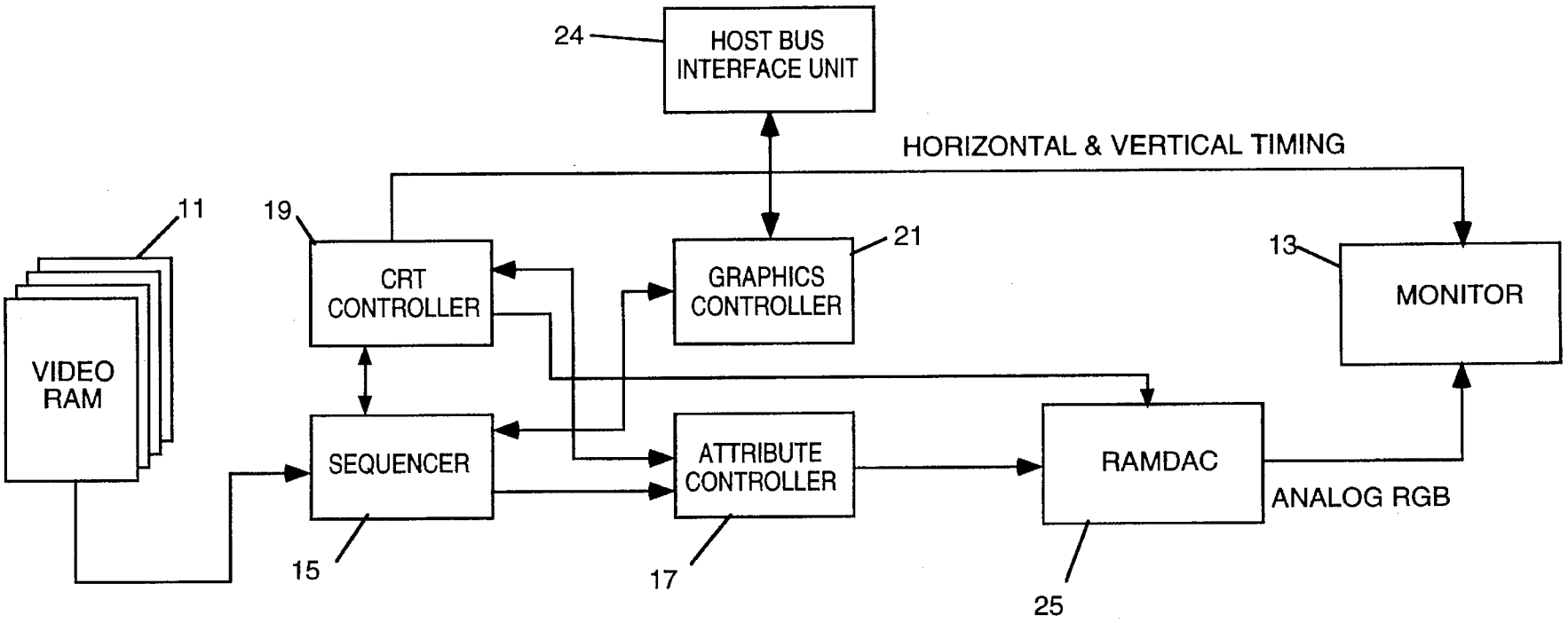
FIG. 1 is a block diagram showing the components of a VGA system.

As shown in FIG. 1, a VGA system includes a video RAM 11 which stores data representing the color of each pixel to be displayed on monitor 13. In one mode, VGA allows for a display having for each pixel 16 possible colors over an array of 640 by 480 pixels. Each pixel is represented by a set of four corresponding bits at the same address in each of four bit planes. These four bits allow for $2^4$ or 16 colors per pixel. Although only 16 colors may be displayed at any one time, in some modes of operation, 256 color registers may be used and appropriate programing allows the use of all 256 colors. The present invention will be described with reference to such 256 color systems, although modifications necessary for operation in other VGA modes should be apparent to persons skilled in the art. In either case, the 16 or 256 colors which may be displayed are selected from over 250,000 possible colors. Details regarding VGA systems are available from a variety of sources. See, for example, *EGA/VGA A ProGrammer's Reference Guide* by Bradley Dyck Kliewer available from McGraw Hill Publishing Company.

The data from the video RAM is input to circuitry which converts the data from the video RAM to a form usable by the monitor. The main components of this circuitry are shown in FIG. 1 as sequencer 15, attribute controller 17, CRT controller 19, graphics controller 21, host bus interface 24 and RAMDAC 25 which includes a look-up table (or LUT which is the RAM part of the RAMDAC) for translating 8 bits of data from RAM 11 to an 18 bit digital RGB signal (6 bits per color) which is converted by a digital to analog converter (DAC) to three analog signals representing voltage levels for red, blue and green which when combined at a pixel create a desired color at that pixel. The particulars of these components are well known in the art and will not be described herein except as necessary for a proper understanding of the invention. In this connection, for the most part, the present invention is directed to certain modifications to these components to provide the enhanced capabilities of the invention.

In particular, the present invention modifies the attribute controller adding registers ERC8 and ERC9, a special RAMDAC clock generator and a special scan line reset for such clock generator, modifies the sequencer adding a register designated ER9B, modifies the CRT controller adding hardware to generate the border* signal, pclk-off* signal, dacoff* signal and compoff* signal, and modifies the RAMDAC adding the true color pixel formatter and video delay compensation circuitry. The invention makes no changes to the graphics controller. In this specification, the addition of * to a signal name indicates that the signal is active low.

BORDER COLOR CONTROL

Figure 2:
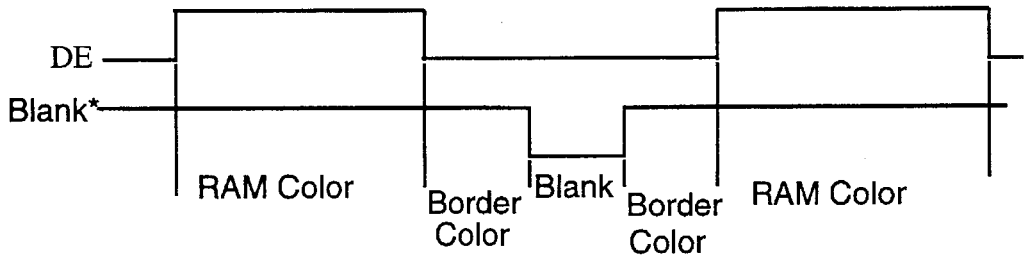
FIG. 2 is diagram showing the relative timings of the signals DE and Blank* used to determine when the border color register should be used.

A prior art VGA RAMDAC displays from the RAM component at all times, except when a signal Blank* is asserted, in which case black is forced at the DAC inputs. However, referring to FIGS. 2 and 3, in the present invention, when both Display Enable (DE) and Blank* are not asserted, the 18 bit input to the DAC 29 is not fetched from the RAM array 31, but rather from a special 18 bit×1 register called the border color register 33. When DE is not asserted and Blank* is asserted, the screen is blank (black) for the entire time Blank* is asserted. Blank* and DE are part of the VGA standard definition.

At that time (i.e., when both DE and Blank* are not asserted), the value on the P[7:0] input pins from video RAM 11 is don't care, as the 18 bit value programmed in the border color register is inputted to DAC 29.

To implement the border color mode, it is necessary to 1) enable the mode; 2) write to the 18 bit border color register; 3) send the contents of the 18 bit border color register to the DAC so as to modify the DAC input based upon the contents of the 18 bit border color register.

Two input signals, RS2 and Border*, are added to the existing inputs to the RAMDAC, in order to support border color mode. When RS2 is not asserted, border color mode is enabled. RS2 is stored in a register ERC8 added to the attribute controller at bit 4 (ERC8[4]*) and is set or reset under software control. When RS2 is asserted, standard RAMDAC I/O addressing is in effect. The other signal, Border*, is the true DE signal, in sync with P[7:0], but gated by ERC8[3]. That is, Border*=(DE & ERC8[3])*. Thus, Border* is asserted only when ERC8[3] is a logic 1.

Figure 3:
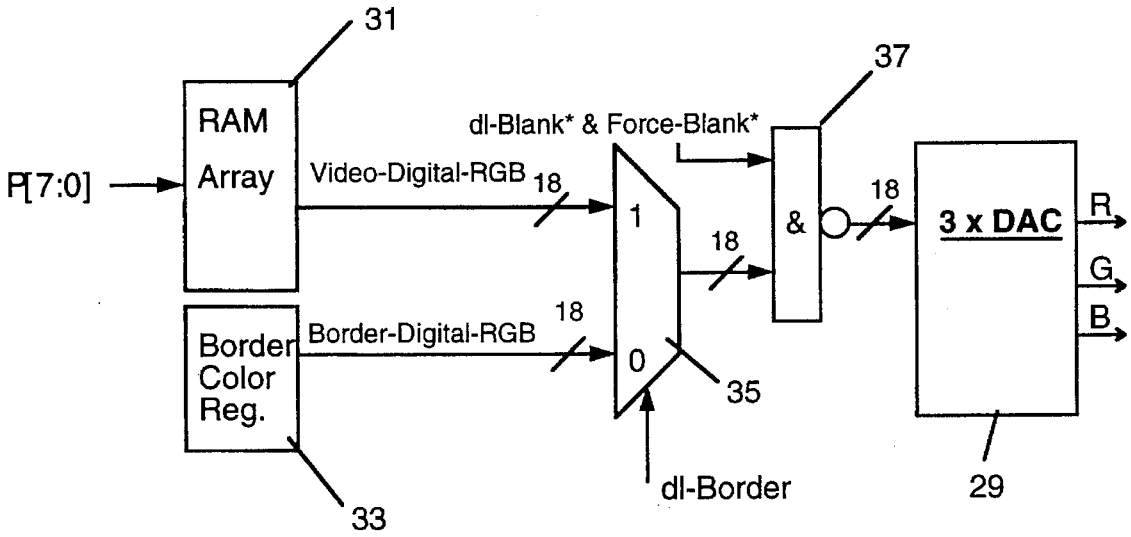
FIG. 3 is a circuit showing an implementation of border color control.

Border input is delayed inside the RAMDAC 25 as much as the signal Blank* is delayed. When Border* is not asserted and Blank* is asserted, the digital RGB from the border color register 33 is presented at the DAC 29 input. This is accomplished as shown in FIG. 3 by using the delayed Border signal (dl-Border) to select either the Video-Digital-RGB or the Border-Digital-RGB through multiplexor 35. The output of multiplexor 35 is then NANDed with the signal delayed Blank* ANDed with Force-Blank* (dl-Blank* & Force-Blank*) by NAND gate 37. The signal Force-Blank* is a bit in register ERC8 (ERC8[5]) which is normally 0, but is set by an AND operation of bit 5 of the DAC Power Control Register (DACPWC[5]) and Screen-Save. DACPWC[5] is set when the monitor is not in use, but the system is in use. For example, when the system is being used with an LCD or other flat panel display device. DACPWC[5] is reset when the VGA controller is used with a CRT. Screen-Save is set when there is no keyboard activity after a predetermined period of time and reset after keyboard activity begins or a video memory command is received.

RS2, when asserted, represents normal RAMDAC I/O mapping. RS2, when not asserted, represents extended I/O space mapping according to the present invention. The RGB border color register 33 is mapped as three registers as follows:

RS2, RS1, RS0=0 0 0.

RS0 and RS1 are standard VGA register select signals and select registers RSC) and RS1 respectively.

RS2 is the output of an Extended Register bit (ERC8[4]) or any software programmable output in cases where the RAMDAC is external to the chip. RS2 is asserted only during the time the border register is written, all under software control.

Three consecutive I/O writes to I/O address 3C8h with RS2=0 (i.e. ERC8[4]=1) will write the border color into border color register 31 in R, G, B order.

Three consecutive I/O reads to I/O address 3C8h with RS2=0 will read the border color register (6 bits at a time) in R, G, B order.

The invention adds a bit (RS2) to the RAMDAC address (RS1, RS0 to provide this capability as shown in the following table:

TABLE I

| RAMDAC ADDRESS | DESCRIPTION | CPU ADDRESS | RS2 = ERC8 [4]* |
|---|---|---|---|
| "000" | Border Color Reg. read/writes | 3c8 (RS1, 0 = 00) | 0 <– extension |
| "001" | reserved | 3c9 (RS1, 0 = 01) | 0 |
| "010" | reserved | 3c6 (RS1, 0 = 10) | 0 |
| "011" | reserved | 3c7 (RS1, 0 = 11) | 0 |
| "100" | VGA Palette write address | 3c8 (RS1, 0 = 00) | 1 <– standard |
| "101" | VGA Palette data | 3c9 (RS1, 0 = 01) | 1 <– standard |
| "110" | VGA address mask | 3c6 (RS1, 0 = 10) | 1 <– standard |
| "111" | VGA Palette read address (write only) | 3c7 (RS1, 0 = 11) | 1 <– standard |

ERC8[3] is the border color enable bit (active 1, default 0).

The RAMDAC gets an input signal called Border*. When Border* is 0, the video data to DAC 29 is taken from the border color register 31, if true-color is disabled (see discussion of true-color below).

In this connection, Border* is defined as: Border*=ERC8[3] & true-DE* where true-DE is the true display enable signal, pixel aligned with the video, affected by both horizontal and vertical display enable.

Automatic Power DOWTA Of the DAC and the Monitor Sense Comparator

To implement this aspect of the invention, a signal called dacoff* is generated by the CRT controller and provided to the RAMDAC. If dacoff* is 0, the Blank effect will be forced at the DAC input and the DAC Analog VDD will be off for all practical purposes.

Another signal called cmpoff* generated by the CRT controller controls monitor sense comparator power (no power if cmpoff* is 0).

dacoff* is asserted low or 0 whenever any of the following three conditions is met:

1. if in LCD display (not asserted though in LCD & CRT display) and if Monitor ID bits are used instead of the on chip monitor sense (the default) (ER9B[1]=1)

2. if in LCD display (not asserted though in LCD & CRT display) and if on chip Monitor Sense is used (ER9B[1]=0), when FEAT (I/O address 3C2) is not read-back (IORD* to FEAT deasserts dacoff* for an extended IORD*)

3. if not in LCD display but in Screen-Save mode (the screen save feature is enabled and the timer triggered the Screen-Save)

In other words:

dacoff*=(ERC8[5]& (LCD a (ER9B[1]+ER9B[1]* & ext-FEATrd)+LCD* & Screen-Save))*

As noted above, the Screen-Save signal comes from the CRT controller screen save timer which may be activated with any display type (CRT, LCD, Plasma/El).

dacoff* is an input to the RAMDAC (active low).

The cmpoff* signal controls the monitor sense comparator power (0 or low means no power).

The monitor sense comparator is powered only when FEAT is read-back for the duration of an extended IORD* pulse if the on-chip monitor sense is enabled (ER9B[1]=0).

In other words:

cmpoff*=ext-FEATrd & ER9B[1]*

In all other cases, cmpoff* is 0 and the monitor sense comparator is not powered.

Suspend RAMDAC-DotClock

When in LCD Suspend mode, which is defined as a power save mode in which all RAMDAC clocks (memory (ipc) and dot (vdclk)) are stopped.

Suspend mode is determined by the state of ERD6[1], where ERD6[6]=1 is Suspend mode and ERD6[6]=0 is normal mode.

Suspend has to force vdclk high in a synchronous manner. ERC8[6] which controls the RAMDAC special input clkoff* as follows:

clkoff*=ERC8[6]q* meaning that clkoff* is the q* output of a latch having two outputs representing ERC8[6], one (q) asserted high and the other (q*) asserted low.

Before asserting Suspend, a "suspend utility program" must not attempt to access the RAMDAC. This restriction helps to comply with the RAMDAC requirement that the clock is on for at least 4 clocks after an I/O access.

True Color Mode Support

Figure 6:
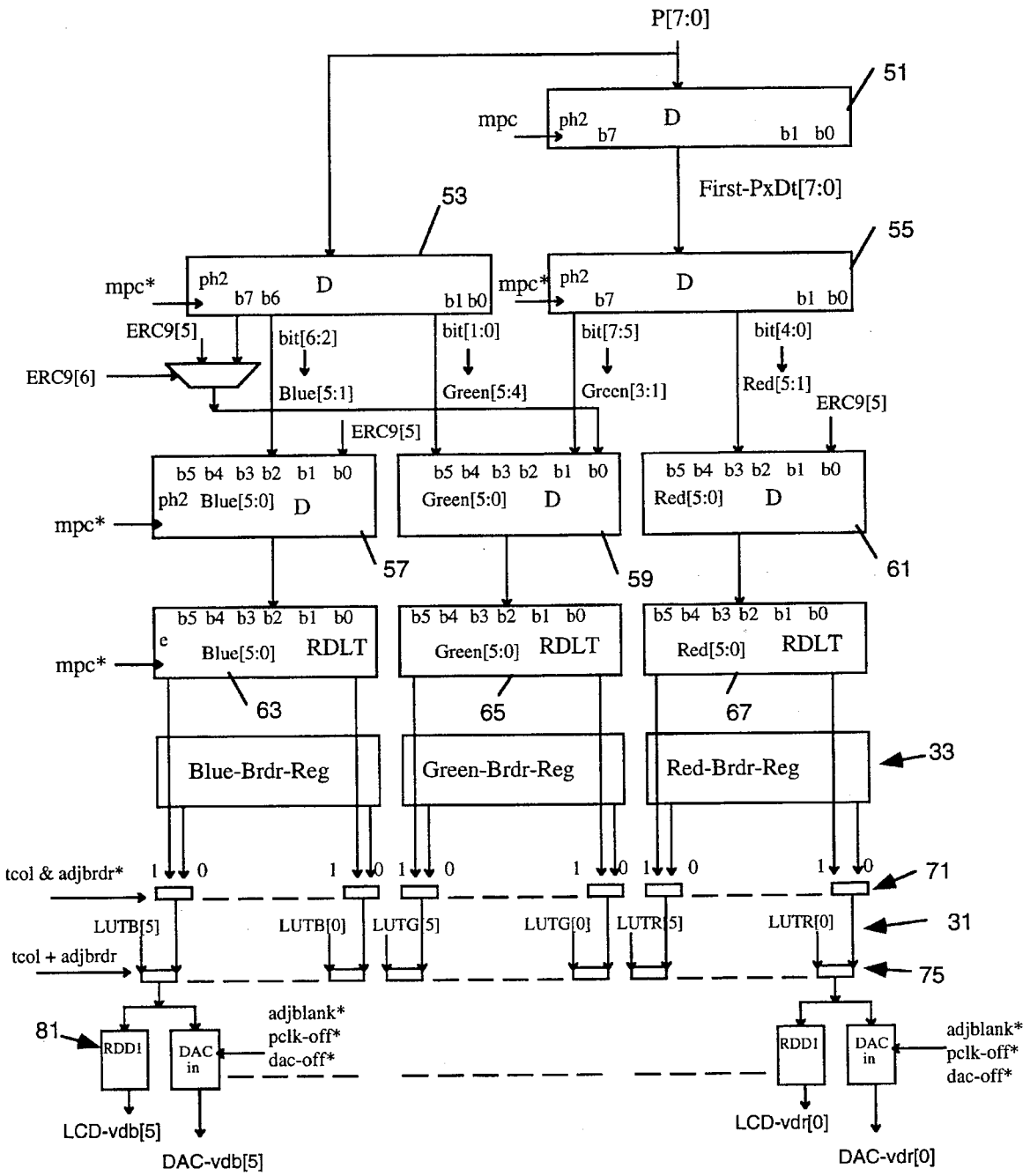
FIG. 6 is a detailed block diagram showing an implementation for true color support.

This feature refers to the capability of supplying RGB control (18 bits of digital RGB) directly to the DAC input, without going through the Look-up Table RAM (LUT). Because the LUT is bypassed, up to 218 or 256 K colors can be displayed. In a preferred embodiment, since a video memory word or 32 bits is used to accommodate the data for two pixels, 216 or 215 colors are supported, with the other bits to total 18 taken from ERC9[5] as shown in FIG. 6, i.e., ERC9[5] is the least significant bit of R and B, and is the least significant bit of G when ERC9[6**] is 0.

In true color mode, the VGA controller runs in 8 bits/pixel at twice the frequency the true color mode will run, but the RAMDAC runs at the standard frequency for that mode as follows:

| Mode | VGA Freq. | RAMDAC Freq. |
|---|---|---|
| 640 × 480 64K or 32K colors | 50 MHz | 25 MHz |
| 640 × 400 64K or 32K colors | 50 MHz | 25 MHz |

Figure 4:
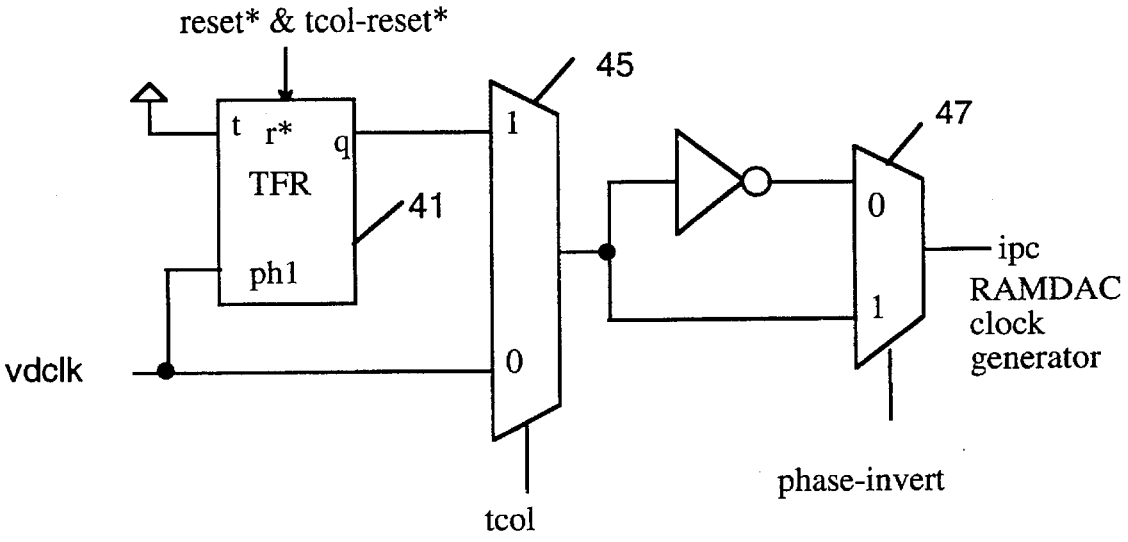
FIG. 4 is a circuit showing an implementation for generating the RAMDAC clock signal for true color support.

In true color mode, the RAMDAC clock "ipc" runs at half the frequency of the attribute clock. The IPC clock generator, in the attribute controller is as shown in FIG. 4. Specifically, clock signal vdclk, which is a standard VGA clock signal is input to the clock input of a toggle flip-flop 41, where the T input is a tied to a logic 1 so that a divide by 2 frequency is obtained. The flip-flop is reset by an AND of the signals reset* and tcol-reset*. The Q output of the flip-flop is one input to a multiplexor 45 with the other input being the vdclk signal. The signal tcol selects the Q output of the vdclk signal (1 selects Q output and 0 selects vdclk). The output of multiplexor 45 or its inverse is the RAMDAC clock ipc depending on phase-invert which selects the output or its inverse from multiplexor 47.

Figure 5A:
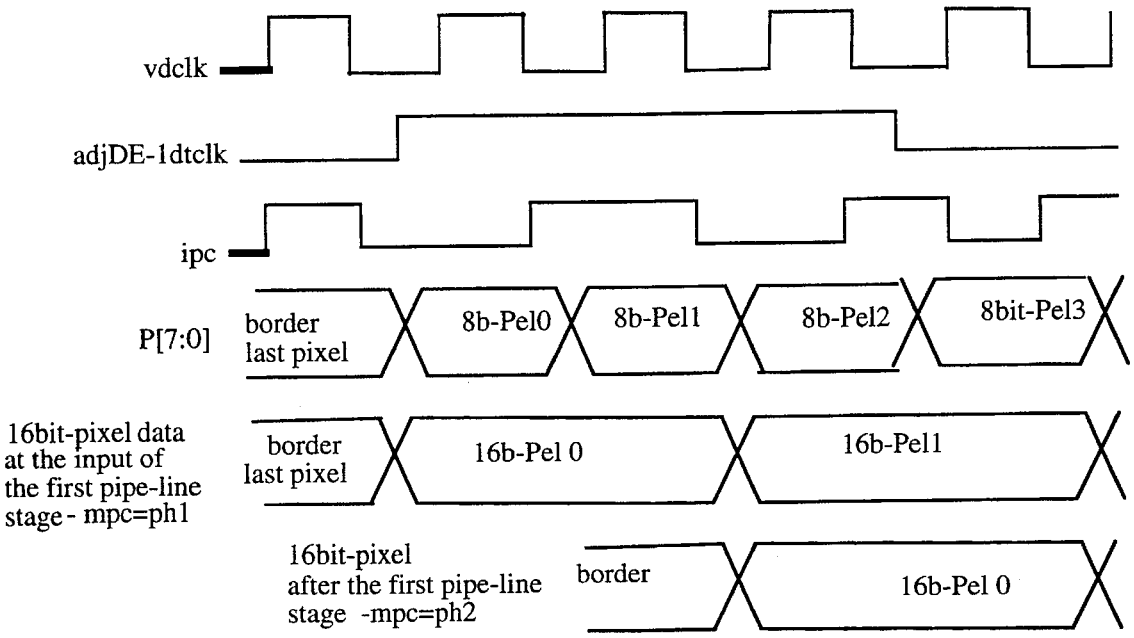
FIG. 5*a* is a RAMDAC clock timing diagram in true color mode showing pixel data segmentation.

FIG. 5*a* shows the input clock to the RAMDAC (ipc) in true color mode as a function of the clock (vdclk) driving the divide by 2 flip-flop 41 and as a function of the adjusted display enable signal (adjDE-1dtclk). FIG. 5*a* also shows the video data processing at various stages of the true color circuit (FIG. 6) as follows: (i) video data at the input (P[7:0]); (ii) at the input of the first pipeline stage (phase 1 of the mpc clock); (iii) and at the output of the first pipeline stage (phase 2 of the mpc clock).

Figure 5B:
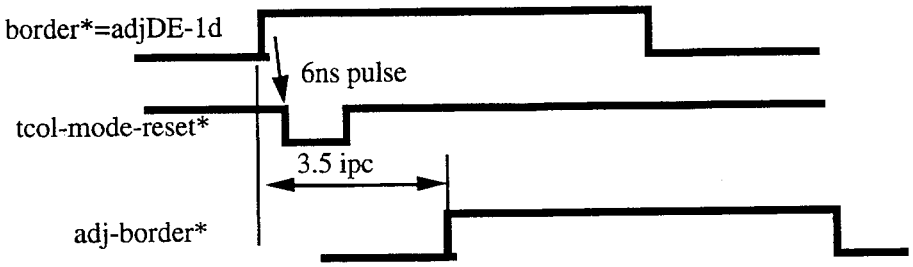
FIG. 5*b* is a true color clock generator synchronization to scan line timing diagram.

FIG. 5*b* shows the true color (toggle flip-flop 41) RAMDAC clock generator reset timing diagram. The circuitry ensures proper pixel pairing to create a 16 bit pixel from the pixel correct halves as they were programmed by the application program and placed in the video RAM 11. The circuitry looks at the rising edge of border* and asserts tcol-reset* one ipc clock later.

FIG. 6 is the RAMDAC (DACSLA) schematic for true color mode support. The pixel data P[7:0] is loaded into latches 51 and 53. This data is converted to red, blue and green data, 6 bits each wherein the bits 1–5 of the blue component (bits 1–5) is bits 2–6 of latch 53 and bit 0 is ERC9[5]; bits 4–5 of the green component are bits 0–1 of latch 53, bits 1–3 are bits 5–7 of latch 55, and bit 0 is ERC9[5] or bit 7 from latch 53 depending on ERC9[6]; the red component (bits 1–5) is bits 0–4 of latch 55 with bit 0 being ERC9[5]. The blue, green and red components are stored in latches 57, 59 and 61 respectively and then loaded into delay latches 63, 65 and 67 respectively.

Multiplexors 71 then select the data from latches 63, 65 or 67 or from border color register 31 depending on tcol AND adjbrdr*. Multiplexors 75 then select the outputs from multiplexors 71 or from the look-up table RAM array 75 depending on tcol OR adjbrdr. The outputs from multiplexors 75 are then provided to the DAC if none of adjblank*, pclkoff* or dacoff* are asserted and to an RDD1 circuit 81 which is a pipeline stage to send video data to the LCD if one is present and in use.

Figure 7:
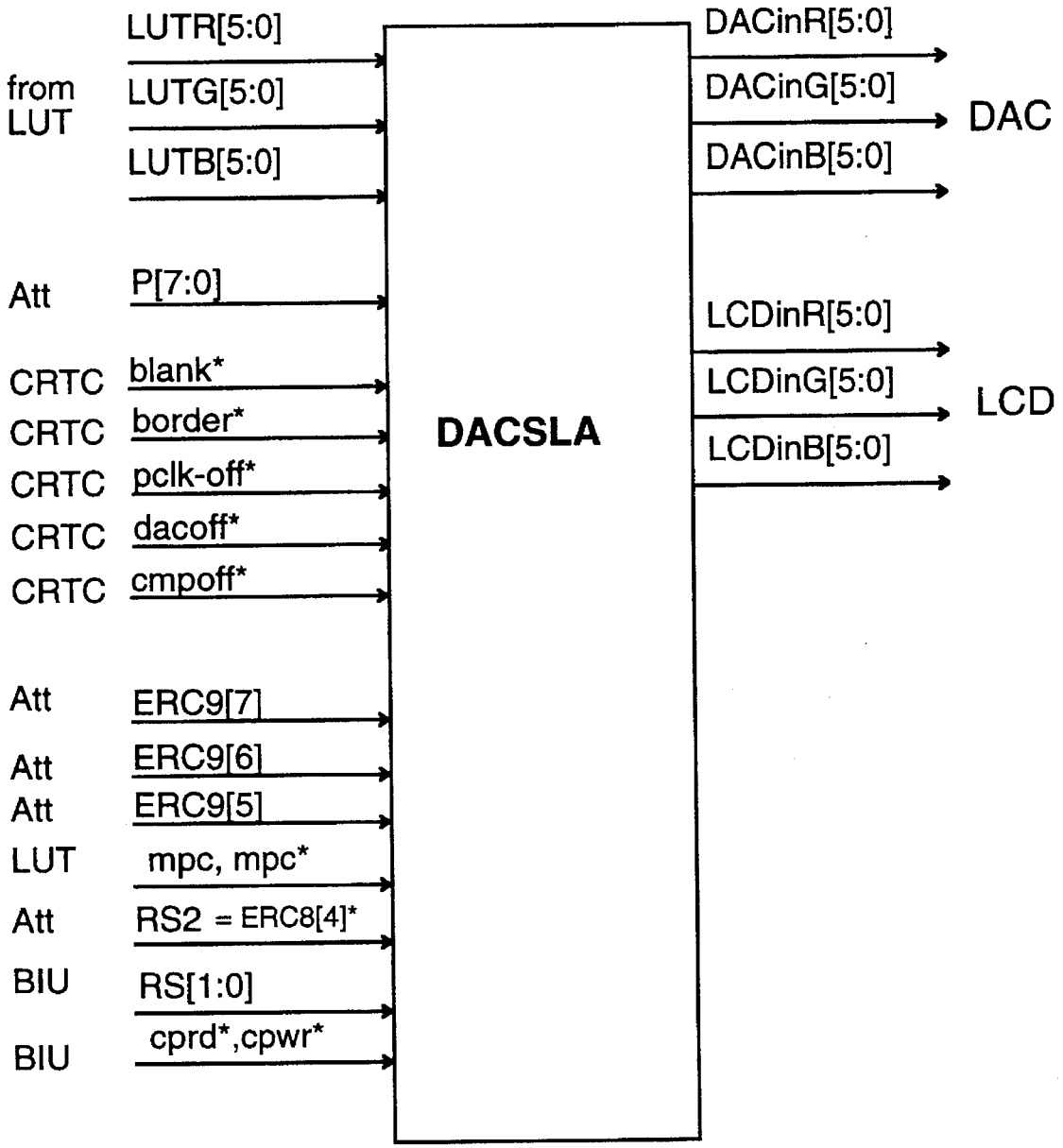
FIG. 7 is a block diagram showing the inputs and outputs of a DAC storage logic array used for implementing the present invention.

A block diagram showing inputs and outputs of a DAC storage logic array which provides the inputs to the DAC or to an LCD display is shown in FIG. 7.

In the Figures, the following table defines the signals used in the Figures. Other signals shown in the Figures but not specified in the table are part of a standard VGA system or were described above. With respect to all of these signals, the specifics of suitable hardware or software necessary to generate such signals should be readily apparent to persons skilled in the field of the invention based upon the description and Figures.

| Symbol | Register Bit | Description |
|---|---|---|
| tcol | ERC9 [7] | true color mode enable bit |
| | ERC9 [5] | least significant RGB bit |
| | ERC9 [6] | Green least significant bit control: if 1, most significant bit of assembled pixel (bit 7 of second byte) is green least significant bit if 0, ERC9 [5] is green least significant bit. |
| pclk-off* | | stop ipc clock-same as clkoff* |
| phase-invert | ERC8 [7] | invert ipc clock |
| adjbrdr | | Border delayed to match video |
| adjblank | | Blank delayed to match video |

We claim:

1. In a personal computer having a color monitor and using a video graphics adapter to place color images from a video RAM on the monitor, said video graphics adapter having a RAMDAC including a RAM array and a digital to analog converter coupled between said RAM array and said monitor, said digital-analog converter adapted to convert a digital signal representing red, blue and green from said RAM array to an analog RGB signal used by the monitor to create a color display, the improvement comprising:

a) a border color register coupled to the digital-analog converter of the video graphics adapter, said border color register for storing user selected red, blue and green colors;

b) means for selecting one of said video RAM and said border color register as a source of color data for each pixel to be displayed on the monitor by the video graphics adapter.

2. The improvement defined by claim 1 wherein each of said red, blue and green colors is represented by a 6 bit value and said border color register is loaded by three writes to said border color register.

3. The improvement defined by claim 1 wherein said selecting means is a multiplexor having said digital-analog converter coupled to its output and having said border color register and said RAM array coupled to its input.

* * * * *

UNITED STATES PATENT AND TRADEMARK OFFICE

CERTIFICATE OF CORRECTION

PATENT NO. : 5,574,478

DATED : November 12, 1996

INVENTOR(S) : Bril et al.

It is certified that error appears in the above-identified patent and that said Letters Patent is hereby corrected as shown below:

In column 3 at line 51, please delete " RSC) " and insert -- RS0 --.

Signed and Sealed this

Twenty-first Day of July, 1998

Bruce Lehman

*Attest:*

BRUCE LEHMAN

*Attesting Officer*

*Commissioner of Patents and Trademarks*